US007114957B2

(12) United States Patent
Duquerroy et al.

(10) Patent No.: US 7,114,957 B2
(45) Date of Patent: Oct. 3, 2006

(54) MICRO-PLUG AND SOCKET CONNECTOR

(75) Inventors: Patrick Marcel Duquerroy, Seligenstadt (DE); Lieven Decrock, Roeselare (BE); Reginald Leeman, Oostende (BE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/070,494

(22) Filed: Mar. 2, 2005

(65) Prior Publication Data

US 2006/0199401 A1 Sep. 7, 2006

(30) Foreign Application Priority Data

Mar. 2, 2004 (EP) ..... 04004887

(51) Int. Cl.
*H01R 12/00* (2006.01)
*H01R 13/648* (2006.01)

(52) U.S. Cl. ..... 439/63; 439/916

(58) Field of Classification Search ..... 439/63, 439/916

See application file for complete search history.

(56) References Cited

U.S. PATENT DOCUMENTS 4,652,977 A * 3/1987 Jones ..... 361/793
5,145,382 A 9/1992 Dickirson
5,562,472 A * 10/1996 Dubois et al. ..... 439/329
5,791,911 A * 8/1998 Fasano et al. ..... 439/63
5,936,581 A * 8/1999 Roshitsh et al. ..... 343/702
6,086,383 A 7/2000 Fasano et al.
6,473,045 B1 * 10/2002 Duquerroy et al. ..... 343/702
6,488,533 B1 * 12/2002 Thompson et al. ..... 439/509
6,881,082 B1 * 4/2005 Jordan et al. ..... 439/188
6,932,615 B1 * 8/2005 Yeo ..... 439/63

FOREIGN PATENT DOCUMENTS

DE 100 51 791 A1 5/2002
EP 0 301 863 A2 2/1989
EP 0 419 938 A2 4/1991

* cited by examiner

*Primary Examiner*—James R. Harvey
(74) *Attorney, Agent, or Firm*—Barley Snyder LLC

(57) ABSTRACT

Disclosed is a micro-plug and socket connector that is suitable for mounting on a printed circuit board and that has a plastic housing including a fastening surface with soldering portions for mounting on the surface of the printed circuit board, a plug receiving opening having an inner contact region for the receiving and contacting a pin contact, and an outer contact terminal. The inner contact region, the outer contact terminal, the soldering portions and the electrically conductive connections provided therebetween are formed of metallized portions on the plastic housing.

10 Claims, 3 Drawing Sheets

MICRO-PLUG AND SOCKET CONNECTOR

FIELD OF THE INVENTION

The invention relates an electrical connector and more particularly to a micro-plug and socket connector for mounting on a printed circuit board and for establishing a plug and socket connection with a coaxial plug.

BACKGROUND

A micro-plug and socket connector of this type is used in cases in which a coaxial cable is to be connected to a printed circuit board. Because mobile telephones, for example, are constantly becoming smaller, the size of micro-plug and socket connectors of this type must also be reduced accordingly.

DE 100 51 791 A1 discloses a connector that is configured for use in mobile telephones and comprises a housing with a contact chamber, which is accessible via an opening for plugging in a plug contact. A U-shaped spring clip, between the arms of which the plug contact that is plugged into the plug receiving opening is fixed, is located in the contact chamber. When the plug contact is not plugged in, the free ends of the two arms abut a metallized, and therefore electrically conductive, projection of the housing. When the plug contact is plugged in, the arms of the spring clip are spread sufficiently far apart that the electric contact between the two arms and the conductive projection is separated. The outer contact terminal and the projection of the housing are in the form of metallized plastic material housing parts.

EP 419 938 A2 discloses a surface mountable coaxial plug and socket connector that has a connector housing, which comprises a substantially cube shaped housing part. Two contacts, an inner contact and an outer contact terminal, punched from a metal sheet, are arranged on the connector housing. Both comprise a terminal lug for soldering to a printed circuit board.

SUMMARY

The present invention provides a micro-plug and socket connector that is particularly easy to produce and may easily be reduced in size. The micro-plug and socket connector is suitable for mounting on a printed circuit board. A housing includes a fastening surface with soldering portions for mounting on the surface of the printed circuit board, a plug receiving opening having an inner contact region for receiving a pin contact, and an outer contact terminal. The inner contact region, the outer contact terminal, the soldering portions and the electrically conductive connections provided therebetween are formed as metallized portions on the plastic housing.

BRIEF DESCRIPTION OF THE DRAWINGS

The invention will now be explained in greater detail with reference to an embodiment. In the drawings.

DETAILED DESCRIPTION OF THE EMBODIMENTS

In all of the figures, the micro-plug and socket connector is shown on a greatly enlarged scale (approx. 20:1). In one practical embodiment, the housing of the micro-plug and socket connector is substantially in the shape of a cylinder having a height of less than 2 mm and a diameter of approximately 3 mm. In practical embodiments, the external height dimension and external side dimensions of the micro-plug and socket connector are in the range of approximately 1 to 5 mm.

Figure 1:
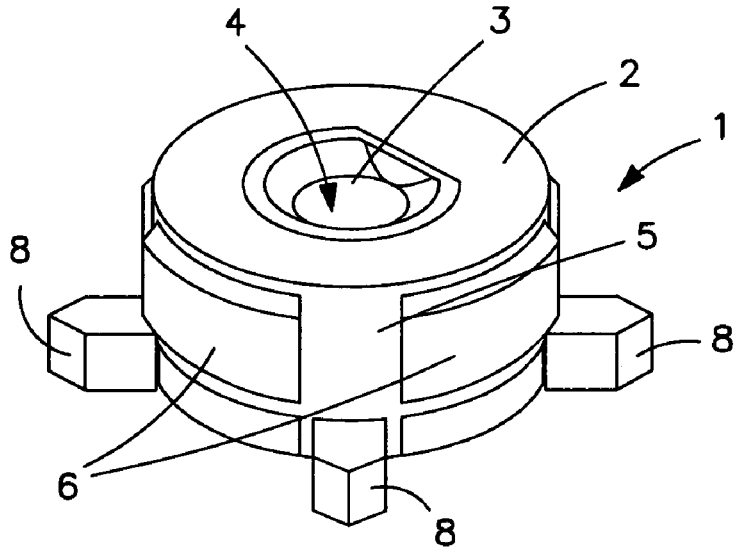
FIG. 1 shows a greatly enlarged perspective view of an embodiment of a micro-plug and socket connector according to the invention.

FIG. 1 shows an oblique view from above of an embodiment of a micro-plug and socket connector 1 according to the invention comprising a housing 2 that is provided on a ceiling wall, which in FIG. 1 is located at the top, with a plug receiving opening 3 for plugging in a pin contact (not shown in the drawings) of a coaxial plug. A cylindrical receiving region 4 for receiving the contact pin is located in the plug receiving opening 3. The plug receiving opening 3 is bevelled, in order to facilitate the insertion of a pin contact. The housing 2 is substantially cylindrical. At four paired opposing points, the side wall 5 is provided with latching projections 6, 7, which may cooperate with a complementary latching device of a mating plug, in order to hold the two connectors together in a plug and socket connection with latching. On four opposing sides, the housing 2 comprises soldering portions 8 provided for soldering to a substrate.

The housing 2 is produced using what is known as the molded interconnect devices (MID) method. In other words, the housing 2 is injected from two different plastic materials, which behave differently with respect to the metallization of their surfaces by plating. The surface of one of the plastics can be plated in a single plating process, whereas the surface of the other plastic does not accept any metal. Selective plating on the desired surface parts of the housing 2 may thus be achieved in a single plating process.

Figure 2:
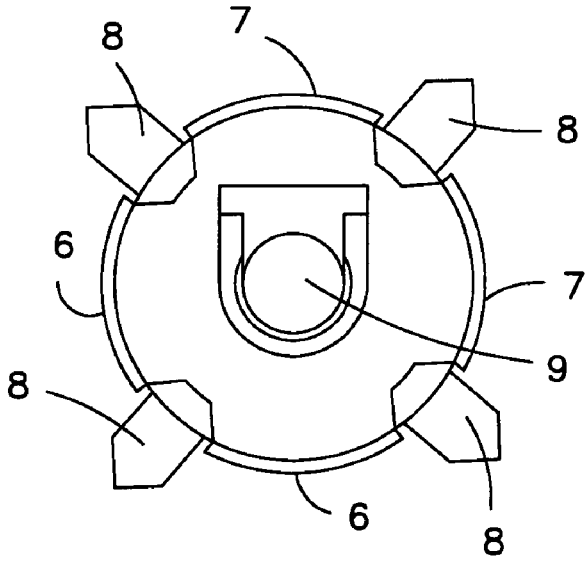
FIG. 2 shows a view from below of the micro-plug and socket connector according to FIG. 1.
Figure 3:
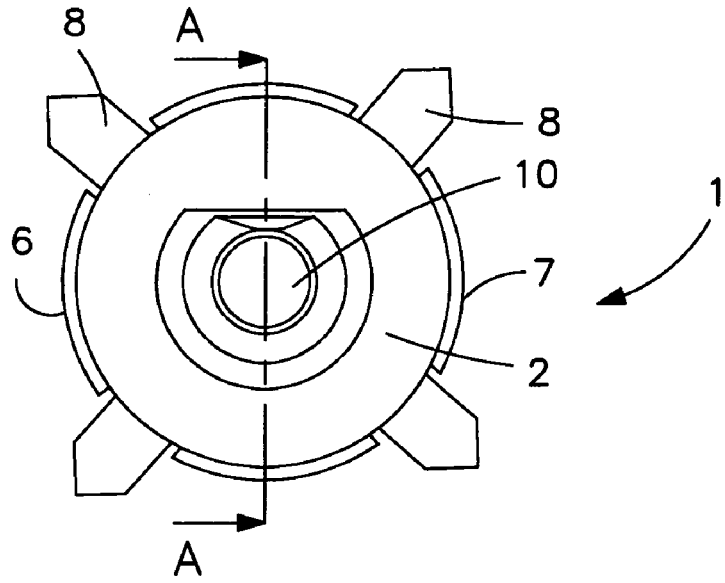
FIG. 3 shows a view from above of the micro-plug and socket connector according to FIG. 1.

FIG. 2 shows a view from below of the micro-plug and socket connector 1. FIG. 2 also contains a view from below of a fifth soldering portion 9, which is arranged below the plug receiving opening 3 and the receiving region 4. FIG. 3 shows a view from above of the micro-plug and socket connector shown in FIG. 1. The stop 10, which is formed as a metallized inner contact region of the housing, may be seen through the plug receiving opening 3 in the receiving region 4. It is configured for connection to an electric terminal, such as a printed circuit board, for example. It is advantageous to configure the inner contact region such that it is angled toward the plug receiving direction, in order thus to be able to compensate any tolerances in the position of the contact pin.

Figure 4:
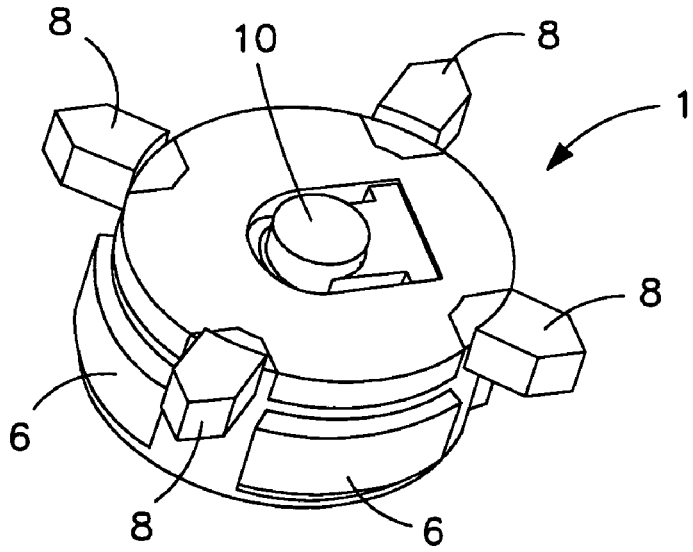
FIG. 4 shows a further greatly enlarged perspective view of the micro-plug and socket connector according to FIG. 1.

FIG. 4 shows an oblique view from below of the embodiment of the micro-plug and socket connector 1 shown in FIG. 1.

Figure 5:
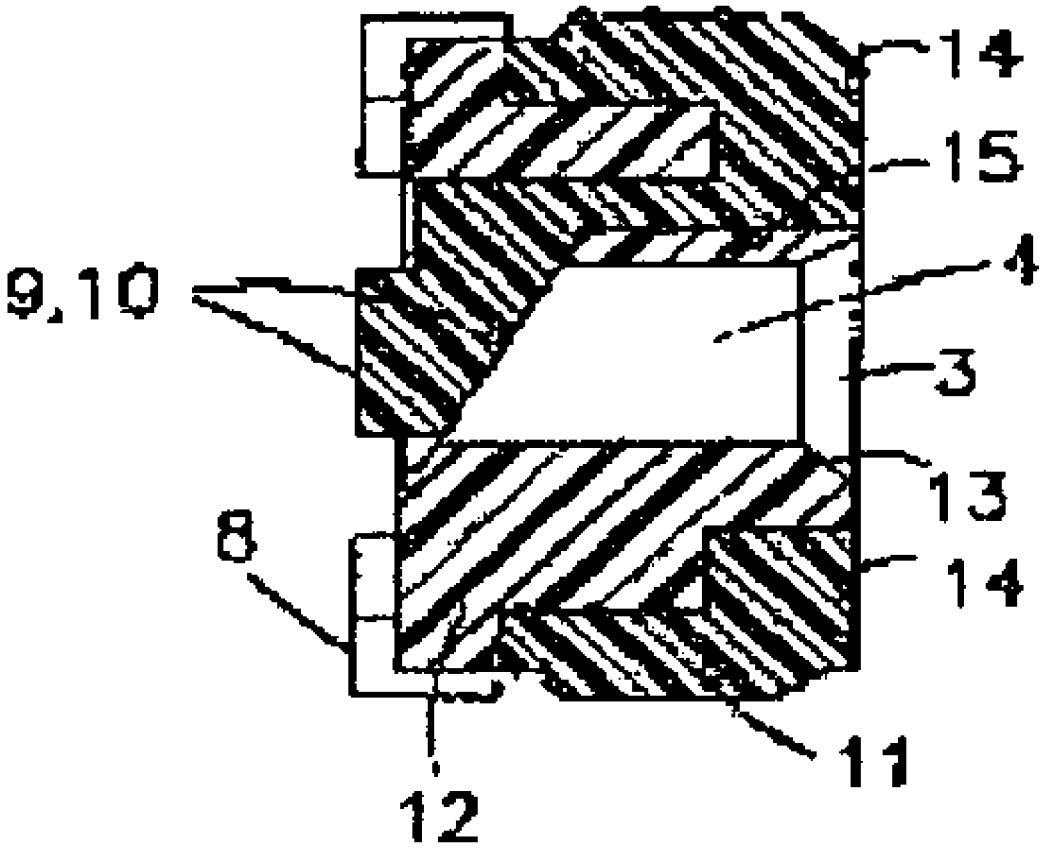
FIG. 5 shows a greatly enlarged sectional view of the micro-plug and socket connector taken along the line A—A in FIG. 3.

FIG. 5 shows a cross section taken along the line A—A of FIG. 3. The parts of the housing 2 that are constructed using a plastic material 11 that may be metallized by plating on its surface are marked with hatching running downward from left to right, whereas the parts of the housing 2 that are constructed using a plastic material 12 that may not be metallized by plating are marked with hatching running downward from right to left. At the location of the plastic material 11, the surface of the housing 2 is electrically conductive, while at the location of the plastic material 12, the surface of the housing 2 is electrically insulative.

The housing 2 comprises a receiving region 4, which is accessible via a plug receiving opening 3 for plugging in a pin contact (not shown). The plug receiving opening 3 is bevelled at its periphery, in order to form an insertion funnel 13, which makes the pin contact easier to plug in.

In one practical application of the micro-plug and socket connector 1 according to the invention, the micro-plug and socket connector cooperates with a coaxial plug contact, which is connected to a coaxial cable. A center conductor of the coaxial cable is connected to the plug contact, which may be plugged into the receiving region 4. An outer conductor of the coaxial cable is connected to an electrically conductive sleeve that coaxially surrounds the plug contact. When the plug contact is completely plugged in, the outer conductor abuts an electrically conductive outer conductor surface 14, which coaxially surrounds the plug receiving opening 3 on the surface at the top of the housing 2 shown in FIG. 5. The outer conductor contact surface 14 is electrically connected to the four soldering portions 8. This connection is produced via electrically conductive metallization of the plastic material 11.

The outer conductor contact surface 14 is electrically separated from the electrically conductive stop 9 and the soldering portion 10 by the insulating zone 15, which is formed by a part of the non-metallized plastic material 12.

What is claimed is:

1. A micro-plug and socket connector for mounting on a printed circuit board and for establishing a plug and socket connection with a coaxial plug, comprising:

a center conductor configured as a pin contact and a coaxial outer conductor;

a plastic housing having a fastening surface, soldering portions for mounting on a surface of the printed circuit board, a plug receiving opening, a receiving region located in the plug receiving opening, an inner contact region having an angled surface stop, located in the receiving region that contacts an end of the pin contact and electrically connects the pin contact to one of the soldering portions, and an outer contact terminal, that contacts the coaxial outer conductor, and electrically connects the coaxial outer conductor to at least another of the soldering portions, the another soldering portion connected to the coaxial outer conductor extending from a side of the plastic housing and substantially perpendicular thereto, the housing being formed of two plastic materials wherein only one of the two plastic materials may be metallized; and the inner contact region, the outer contact terminal, and the soldering portions of the plastic housing being metallized.

2. The micro-plug and socket connector according to claim 1, wherein an outer side of the housing is provided with a latching device for latching with a complementary latching device of the coaxial plug.

3. The micro-plug and socket connector according to claim 1, wherein the inner contact region is configured as a plane inclined toward a plug receiving direction.

4. The micro-plug and socket connector according to claim 1, wherein the inner contact region is configured as a plane perpendicular to a plug receiving direction.

5. The micro-plug and socket connector according to claim 1, wherein the housing has an external height dimension and an external diameter of approximately 1 to 5 mm.

6. A micro-plug and socket connector for mounting on a printed circuit board and for establishing a plug and socket connection with a coaxial plug, comprising:

a center conductor configured as a pin contact and a coaxial outer conductor;

a plastic housing having soldering portions for mounting on a surface of the printed circuit board, a plug receiving opening having a receiving region, an inner contact region located in the receiving region that contacts the pin contact and electrically connects the pin contact to one of the soldering portions, the inner contact region being inclined toward a plug receiving direction at a location which electrically connects to an end of the pin contact, and an outer contact terminal that contacts the coaxial outer conductor and electrically connects the coaxial outer conductor to at least another of the soldering portions, the housing being formed of two plastic materials wherein only one of the two plastic materials may be metallized; and the inner contact region, the outer contact terminal, and the soldering portions of the plastic housing being metallized.

7. The micro-plug and socket connector according to claim 6, wherein an outer side of the housing is provided with a latching device for latching with a complementary latching device of the coaxial plug.

8. The micro-plug and socket connector according to claim 6, wherein the inner contact region is configured as stop having a plane inclined toward a plug receiving direction.

9. The micro-plug and socket connector according to claim 6, wherein the housing has an external height dimension and an external diameter of approximately 1 to 5 mm.

10. The micro-plug and socket connector according to claim 6, wherein the soldering portion connected to the coaxial outer conductor extends from a side of the plastic housing and substantially perpendicular thereto.

* * * * *